United States Patent [19]

Violette

[11] 4,023,787

[45] May 17, 1977

[54] MITERING APPARATUS AND VISE MEANS

[76] Inventor: Jean Violette, 150 Stewart St., Lake City, S.C. 29560

[22] Filed: Mar. 9, 1976

[21] Appl. No.: 665,305

[52] U.S. Cl. ..... 269/41; 269/155; 269/253

[51] Int. Cl.[2] ..... B25B 5/14

[58] Field of Search ..... 83/471.3; 269/41, 42, 269/228, 253, 153, 155

[56] References Cited

UNITED STATES PATENTS

| | | | |
|---|---|---|---|
| 159,573 | 2/1875 | Hempel | 269/42 |
| 415,637 | 11/1889 | Haveisen et al. | 269/41 |
| 879,547 | 2/1908 | Holter | 269/42 |
| 1,730,510 | 10/1929 | Jensen | 269/42 |
| 2,908,300 | 10/1959 | Hahn | 269/41 |
| 3,682,467 | 8/1972 | Heinrich | 269/41 |
| 3,771,757 | 11/1973 | Black | 269/41 |
| 3,888,476 | 6/1975 | Barton | 269/41 |
| 3,944,200 | 3/1976 | Huntley | 269/42 |

*Primary Examiner*—James L. Jones, Jr.

*Assistant Examiner*—Robert C. Watson

*Attorney, Agent, or Firm*—B. P. Fishburne, Jr.

[57] ABSTRACT

A mitering apparatus for frames or moldings includes a base plate on which mitering saw guides and a pair of work holding vises or clamps are mounted. Each clamp has a fixed and a movable jaw and the two clamps are mountable on the base plate for either a standard 45° cut or for a 30° or 22-½° cut in some instances. Guideways for the two clamps or vises are provided on the base plate for coaction with a pivoted clamp adjusting lever and links which interconnect the lever with the clamps so that they may be adjusted bodily in unison and oppositely along linear paths to assure perfect alignment of the mitered ends of molding sections or other work prior to joining by means of nails or glue. Realignment of the joint is also possible if slippage of parts should occur during nailing. It is unnecessary to unclamp the work sections or loosen the movable clamp jaws to effect proper alignment or realignment of the work.

10 Claims, 5 Drawing Figures

FIG. 3
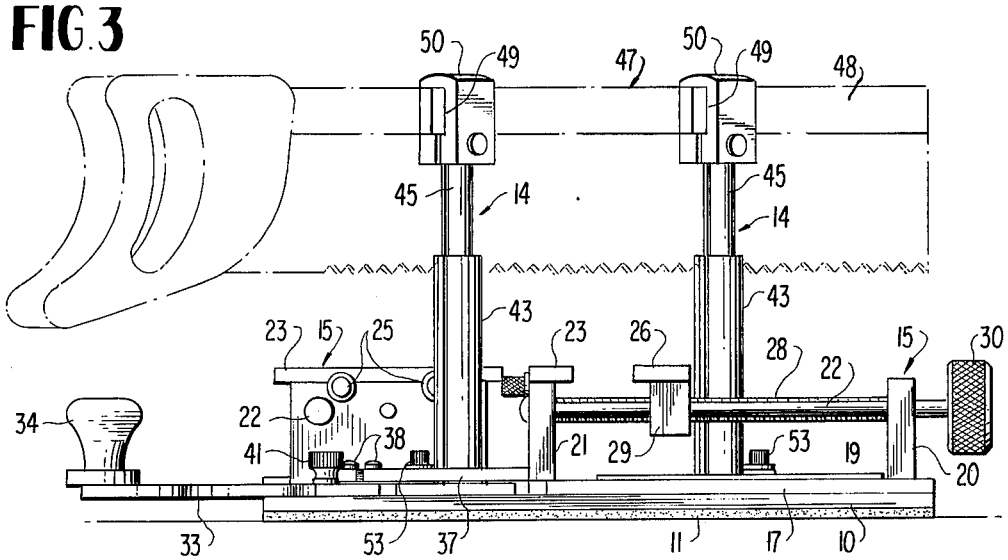
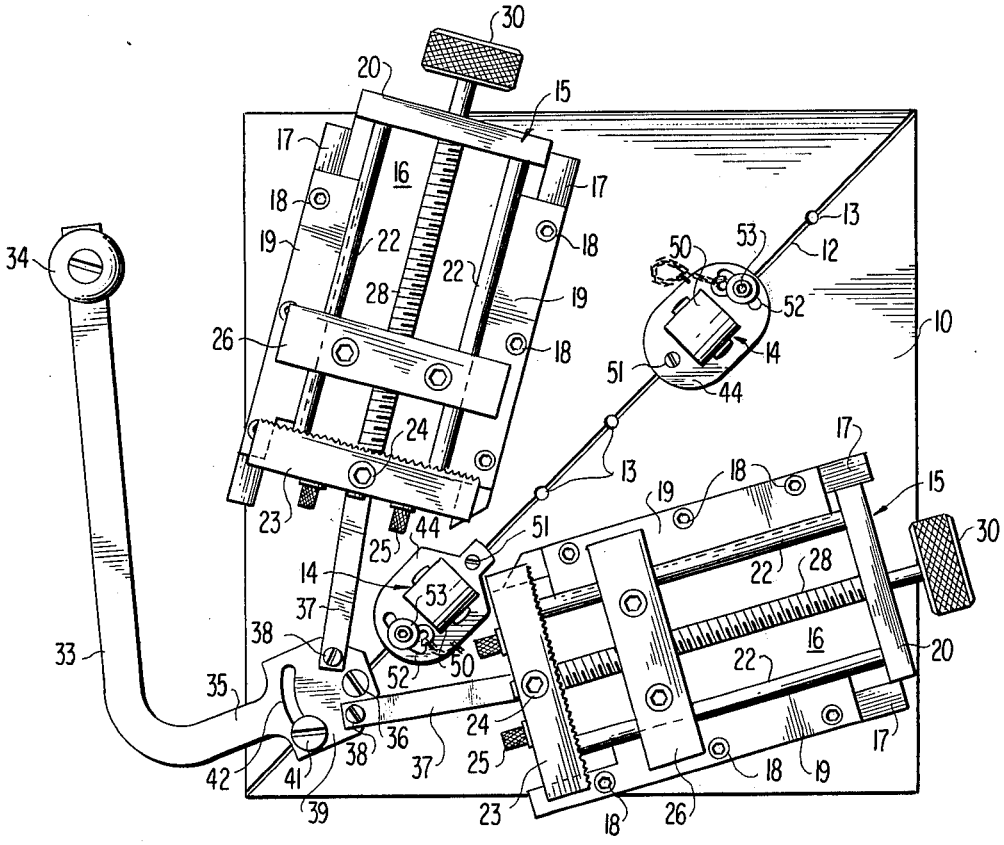
FIG. 4

MITERING APPARATUS AND VISE MEANS

BACKGROUND OF THE INVENTION

A variety of mitering devices are known in the prior art for clamping and aligning work pieces, such as moldings or picture frame sections, during sawing operations and/or for holding the work pieces while they are being permanently joined by nails, glue or both. Known examples of the prior patented art are U.S. Pat. Nos. 505,024; 1,704,747; 2,941,557 and 3,812,751.

The objective of the present invention is to improve on the prior art by providing a mitering apparatus which is more versatile and more efficient and particularly an apparatus which has the ability to substantially perfectly align the mitered ends of work pieces and to hold them aligned during nailing operations and to re-establish alignment if some movement should occur during the nailing without the necessity for loosening the work clamp or vise jaws at any time.

It is a further object of the invention to achieve the last-mentioned alignment feature by means of a simple manually operated mechanism which is coupled to the two vises or clamps of the apparatus for shifting them along two linear paths in opposite directions and for locking the two clamps in selected adjusted positions when the proper alignment of the work piece mitered ends has been achieved.

The apparatus is simple in construction, rugged and durable, compact and does not require skill to operate. In fact, its usage in perfecting a miter joint for a frame or the like totally removes skill from the operation so that anyone can produce an almost perfect joint each time the invention is utilized.

Other features and advantages of the invention will become apparent to those skilled in the art during the course of the following detailed description.

BRIEF DESCRIPTION OF DRAWING FIGURES

FIG. 3 is a side elevational view of the apparatus.

FIG. 4 is a plan view of the apparatus with the two clamps or vises mounted for securing work pieces whose ends have been mitered to 30° instead of the usual 45°.

DETAILED DESCRIPTION

Figure 1:
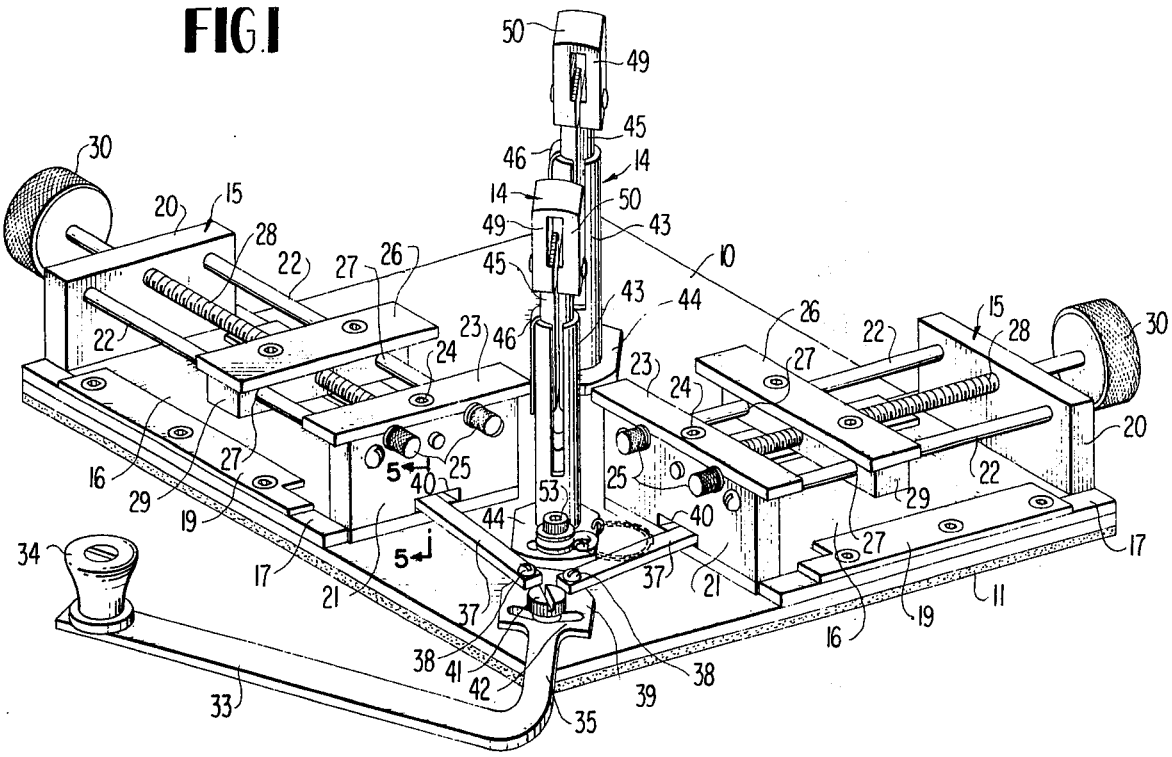
FIG. 1 is a perspective view of a mitering apparatus embodying the invention.

Referring to the drawings in detail wherein like numerals designate like parts, the numeral 10 designates a preferably square flat and rigid base plate having a friction and cushioning pad 11 adhered to its bottom face for convenience during usage. A corner-to-corner straight diagonal reference groove 12 is preferably formed in the top face of the base plate 10 and along this groove the base plate is provided with a plurality of equidistantly spaced threaded openings 13 to facilitate the attachment of miter saw guides 14 at different locations along the diagonal, as will be further described.

Also mounted on the flat base plate 10 at any one of three possible locations thereon are a cooperating pair of mitering clamps 15, vises or work holders. Each vise comprises a bottom flat slide plate 16 whose longitudinal side edges are accurately guided along linear paths by a pair of spaced parallel guide bars 17 which are fixedly attached to the top of base plate 10 by a plurality of screws 18. Slide hold-down plates 19 are also held by the same screws 18 on the tops of guide bars 17, the hold-down plates 19 overlapping the tops of slide plates 16 along the longitudinal edge portions thereof.

Each vise or clamp 15 has an outer end upstanding wall or end plate 20 rigidly attached to the slide plate 16 and a coacting inner end upstanding wall or plate 21 also fixedly attached to the slide plate 16 in spaced opposed relation to the outer end plates 20. A pair of preferably cylindrical spaced parallel guide bars 22 or rails extend between the vise end plates 20 and 21 in vertically spaced relationship to the slide plates 16 and with their ends rigidly attached to the end plates 20 and 21.

A fixed work-engaging jaw 23 is carried by the top of each vise inner end plate 21 and pivoted thereto at 24 and provided on opposite sides of this pivot with an extremely fine squareness adjusting screw means 25 of a conventional type. The screw means 25 have threaded engagement in the adjacent end plates 21, and their heads abut the edges of jaws 23 whereby the jaws may be turned very slightly, if necessary, on their pivots 24 to achieve squareness with the guideway bars 22 for the movable jaws of the device. This feature assures a very accurate alignment of the stationary jaws 23 to compensate for any slight misalignment of the vise guideways. The stationary jaws 23 are locked in their proper adjusted positions by the cooperating means 24 and 25.

Each vise 15 has a moving jaw 26 which is accurately guided by the bars or rails 22 during movement in a linear path toward and away from the stationary jaw 23. Each movable jaw 26 has openings 27, FIG. 1, formed therethrough which slidably receive the parallel guide bars 22. Each movable jaw 26 is propelled toward or away from the opposing stationary jaw 23 by a screw shaft 28 having swiveled engagement with the upstanding end plates 20 and 21 and screw-threaded engagement with a body member 29 of the movable jaw 26. Each screw shaft 28 carries a manual knob 30 at its outer end to facilitate turning.

A primary feature of the invention resides in the provision of means to simultaneously move or adjust the two vises 15 bodily in unison in opposite directions in their guideways 17–19 on the base plate 10. This feature makes it possible to maintain substantially perfect alignment between the mitered end faces 31, FIG. 2, of a pair of frame or molding sections 32 being joined in the apparatus as by nailing across the end faces 31. This nearly perfect alignment feature of the invention is achieved without the necessity for releasing or loosening the work clamping jaws 23 and 26, which may remain secure during the relative linear adjustment of the two vises.

Figure 5:
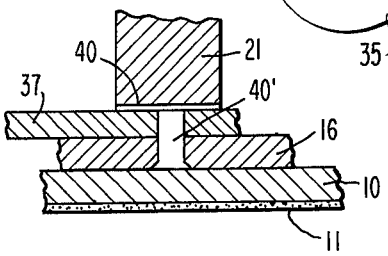
FIG. 5 is an enlarged fragmentary vertical section taken in line 5—5 of FIG. 1.

The said means for producing the simultaneous linear adjustment of the work holding vises 15 comprises a single manual operating lever 33 having a convenience knob 34 and being preferably L-shaped for compactness with its shorter arm portion 35 pivoted to the base plate 10 through a pivot element 36 which is centered on the diagonal groove or line 12. A pair of drive links 37 are pivotally attached at 38 to a head portion 39 of the lever 23 on opposite sides of the pivot 36 and spaced equidistantly therefrom. The opposite ends of the drive links 37 are pivotally attached to the slide plates 16 of the vises 15 within clearance slots 40 provided in the inner end plates 21. This arrangement is shown in FIG. 5 including the pivot element 40' for the drive line 37 on each vise base or slide plate 16. With this symmetrical arrangement, movement of the lever 33 on its pivot 36 in either direction will cause the two slide plates 16 and the vise or clamping means thereon to move oppositely and for equal distances in the linear guideways formed by the bars 17 and plates 19. This movement allows the mitered end faces 31 of work elements 32 to be perfectly aligned for nailing, or to be re-aligned should any slight slippage of the elements 32 occur during nailing. As can be best seen in the phantom lines for the elements 32 in FIG. 2, the simultaneous shifting bodily of the two vises 15 in their linear guideways on the base plate 10 causes the mitered end faces 31 of the workpiece elements to slide or shift in one direction or the other along their mitered abutment line or plane. In this manner, the end faces 31 are precisely matched before gluing or nailing, as stated.

After proper adjustment of the vises 15 and work end faces 31 has been achieved by the lever means 33, as described, the lever means may be locked securely in the selected adjusted position by the tightening if a clamping screw 41 which has threaded engagement with the base plate 10 and which extends through an arcuate slot 42 in the head portion 39 centered on the pivot element 36.

The mitering apparatus also comprises the previously-mentioned saw guides 14 on the base plate 10. Each saw guide has a fixed tubular base section 43 attached through a bottom flange 44 to the base plate 10. Each saw guide 14 comprises an upper vertically adjustable section or stem 45 fitting snugly and telescopically into the bore of the associated base section 43 and tending to remain in the desired height adjusted position under influence of the holding action of a leaf spring element 46, FIG. 1, on each base section 43 of the miter saw guides. The two sections 43 and 45 of each saw guide 14 are slotted in the usual manner to accept a standard mitering saw 47, FIG. 3, the enlarged upper longitudinal bead of which at 48 is slidably supported in passages 49 formed through head elements 50 of the upper guide sections 45. In this way, the mitering saw 47 can be engaged releasably through the two spaced guides 14 and adjusted to the proper height relative to the work element 32 to be cut, such as a frame or molding section, and the cutting or sawing can then be done in the usual manner common to mitering boxes or devices.

A further feature of the invention provides for a slight angular deviation from 45 degrees when a cut is made with the saw 47, as may be desirable when working on materials having a slight variation in widths. To achieve this, the flange 44 of each saw guide base section 43 is pivotally secured at 51 to the base plate 10 on the diagonal groove 12. At the opposite end of each flange 44, an arcuate slot 52 is provided centered on the axis of pivot element 51, and an adjustable clamping screw 53 having threaded engagement with the base plate 10 extends through the slot 52 and may be released and tightened to secure the flange 44 in the selected angular position to establish a mitering cut slightly over or under a true 45 degree cut when desirable.

Figure 2:
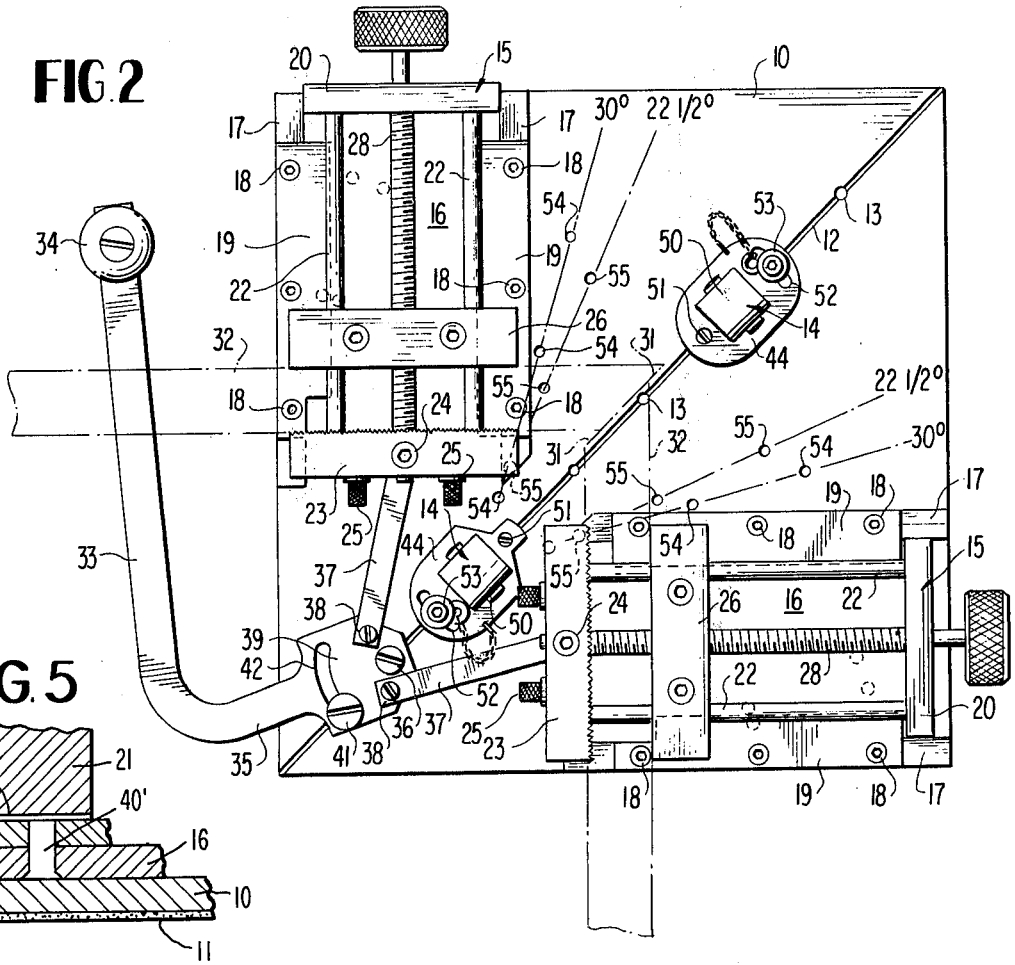
FIG. 2 is a top plan view thereof illustrating the critical adjusting means for the two mitering clamps or vises.

As previously noted, an arrangement is provided in the apparatus for mounting the two vises 15 in a right angular relationship, FIGS. 1 and 2, for producing a standard 45 degree miter cut and miter joint and for also mounting the two vises in a proper selective angular relationship as depicted in FIG. 4 to produce a 60° corner where the two work pieces are joined, instead of 90° as in FIG. 2, or a 45° corner in still other instances. To facilitate this, the base plate 10 is equipped with first rows of threaded openings to receive the screws 18 as they are now shown in FIG. 2, with second rows of openings 54 to allow the formation of the 60 degree corner, FIG. 4, and with third rows of openings 55 to position the two vises for a 22½° cut or 45 degree corner, in some cases. This renders the apparatus more versatile in its ability to vary the angle of cuts and to vary the total included angle of the corner produced between mitered work sections.

In light of the above description, it is believed that the described features of the invention should now be readily apparent to those skilled in the art. Again, the principal feature of the invention is embodied in the lever means 33 to adjust the two vises 15 simultaneously on linear paths in opposite directions to align the mitered end faces 31 of work sections with great accuracy at the time of joining.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A mitering apparatus comprising a base plate, a pair of vises on the base plate in a fixed angular relationship and each adapted to hold a work piece having a mitered end face, linear guideway means for said vises on the base plate whereby the vises can be bodily shifted in opposite directions along linear paths defined by said guideway means, and a common operator means on the base plate for the two vises and being operatively connected therewith in such a way that the two vises can be simultaneously moved in opposite directions along said linear paths by said common operator means to precision align said mitered end faces of work pieces by sliding the mitered end faces on each other in opposite directions.

2. A mitering apparatus as defined by claim 1, and saw guide means mounted on the base plate between said vises and symmetrically arranged relative to the vises whereby work pieces held by the vises can be sawed to produce mitered end faces thereon prior to joining the work pieces at the end faces.

3. A mitering apparatus as defined by claim 2, and said saw guide means comprising a pair of spaced saw guide assemblies on the base plate and each assembly being pivotally secured to the base plate on a line between the two vises and spaced equidistantly therefrom, and adjustable clamping means for each saw guide assembly secured to the base plate and allowing limited angular adjustment of each assembly on the pivot thereof so that mitering cuts may deviate from a predetermined angle to compensate for variations in the widths of work pieces.

4. A mitering apparatus as defined by claim 1, and said common operator means comprising a manual lever pivotally attached to the base plate midway between corresponding ends of said vises, and a pair of drive links pivotally connected with said lever and with said corresponding ends of the vises whereby turning of the lever on its pivot will produce simultaneous linear displacement of the vises in their guideway means in opposite directions relative to the pivot of said lever.

5. A mitering apparatus as defined by claim 4, and adjustable clamp means to releasably lock said lever in selected adjusted positions on said base plate.

6. A mitering apparatus as defined by claim 4, and corresponding ends of said drive links pivotally attached to said lever on opposite sides of the pivot of the lever and spaced equidistantly from said pivot, said drive links being of equal lengths and the other ends of the drive links pivotally attached to said vises at the leading ends thereof and on the longitudinal center lines of the vises.

7. A mitering apparatus as defined by claim 1, and each vise of said pair comprising a slide plate having guided engagement with said linear guideway means, a fixed and an opposing movable jaw above said slide plate, linear guide means for the movable jaw above said slide plate, and a threaded operator for the movable jaw above said slide plate whereby the movable jaw is shiftable toward and away from said fixed jaw.

8. A mitering apparatus as defined by claim 1, and means on said base plate to mount said vises in plural angular positions relative to each other and relative to a symmetrical cutting line between the vises whereby the angles of mitered work piece end faces may be varied and the included angles between joined mitered work pieces may be varied

9. A mitering apparatus as defined by claim 8, and said last-named means comprising plural rows of threaded openings in said base plate arranged at different angles relative to said cutting line, and said linear guideway means including spaced parallel guide bars for said vises on said mounting plate each having plural spaced openings adapted to register with the threaded openings in said rows.

10. A mitering apparatus as defined by claim 4, and said manual lever comprising a generally L-shaped lever having a long arm portion and a short arm portion, said short arm portion pivotally attached to said base plate near one corner thereof with the long arm portion projecting beyond the margin of the base plate, the base plate being substantially square.

* * * * *